US010093013B2

(12) United States Patent
Smith et al.

(10) Patent No.: US 10,093,013 B2
(45) Date of Patent: Oct. 9, 2018

(54) POWER TOOL AND COMBINED HOUSING THEREOF

(71) Applicant: CHERVON INTELLECTUAL PROPERTY LIMITED, Road Town (VG)

(72) Inventors: Derek Smith, Nanjing (CN); Yan Ding, Nanjing (CN); Shihe Nie, Nanjing (CN); Lai Liu, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 537 days.

(21) Appl. No.: 14/694,193

(22) Filed: Apr. 23, 2015

(65) Prior Publication Data

US 2015/0306757 A1 Oct. 29, 2015

(30) Foreign Application Priority Data

Apr. 23, 2014 (CN) ..... 2014 1 0165986
Apr. 23, 2014 (CN) ..... 2014 2 0201317

(51) Int. Cl.
*B25F 5/02* (2006.01)
*B25F 5/00* (2006.01)

(52) U.S. Cl.
CPC ..... *B25F 5/006* (2013.01); *B25F 5/02* (2013.01)

(58) Field of Classification Search
None
See application file for complete search history.

(56) References Cited

U.S. PATENT DOCUMENTS 4,111,862 A * 9/1978 Geschwender ..... B32B 3/12 156/279
5,017,109 A * 5/1991 Albert ..... B25B 21/00 418/152
6,550,145 B2 * 4/2003 Stoll ..... A01D 34/905 173/162.1
2004/0098836 A1 * 5/2004 Walker ..... B25F 5/006 16/430
2007/0295522 A1 * 12/2007 Bohne ..... B25D 17/043 173/162.2
2010/0095533 A1 * 4/2010 Takahashi ..... A01G 3/053 30/228
2011/0005790 A1 * 1/2011 Frank ..... B25F 5/006 173/162.2
2014/0056660 A1 * 2/2014 Eshleman ..... B25B 21/00 408/9

* cited by examiner

*Primary Examiner* — Michelle Lopez
*Assistant Examiner* — Chinyere Rushing-Tucker
(74) *Attorney, Agent, or Firm* — Greenberg Traurig, LLP

(57) ABSTRACT

A combined housing for a power tool has an inner housing body and an outer layer body attached to the outside of the inner housing body. The combined housing has at least one vibration-suppressing area. The vibration-suppressing area is provided with a plurality of vibration-suppressing structure units and each vibration-suppressing structure unit has a unit channel formed by the inner housing body and a unit groove formed by the outer layer body and arranged on one end of the unit channel. The unit groove and the unit channel of each vibration-suppressing structure unit form a vibration-suppressing cavit, and the outer layer body serves as the outside of the outer housing.

18 Claims, 4 Drawing Sheets

POWER TOOL AND COMBINED HOUSING THEREOF

RELATED APPLICATION INFORMATION

This application claims the benefit of CN201410165986.8, filed on Apr. 23, 2014, and CN201420201317.7, filed on Apr. 23, 2014, the disclosures of which are incorporated herein by reference in their entirety.

BACKGROUND

The present disclosure relates to a power tool and a combined housing thereof.

A power tool usually causes vibrations due to the operation of an inner power member and a transmission member therein. The vibrations usually affect the operation experience and especially the handling feeling of the users. Upon operating for a long time, the frequent vibrations cause the users to feel tired, because the users have to overcome the effect caused by the vibrations during the operation. This situation is more obvious in power tools such as sanders and angle grinders because the operation modes of such tools usually cause the tool bodies to generate vibrations.

In order to solve the above problems, a flexible material is generally arranged on the handling portion of the outer housing of the power tool, and the vibrations may be reduced with the flexible characteristic of the material. However, if the thickness of the flexible material is too thin, a desired vibration-suppressing effect cannot be obtained; if too thick, the power tool cannot be accurately handled by the users.

SUMMARY

The present disclosure provides a power tool, comprising an outer housing and an inner assembly accommodated in the outer housing, wherein the outer housing comprises a combined housing having at least one vibration-suppressing area, the vibration-suppressing area comprising an inner housing body and an outer layer body attached to the outside of the inner housing body.

Further, the vibration-suppressing area may be provided with a plurality of vibration-suppressing structure units wherein each vibration-suppressing structure unit comprises a unit channel formed by the inner housing body and a unit groove formed by the outer layer body and arranged on one end of the unit channel with the unit groove and the unit channel of each vibration-suppressing structure unit forming a vibration-suppressing cavity.

The outer layer body is preferably located outside of the outer housing when the combined housing forms the outer housing.

DETAILED DESCRIPTION

An exemplary power tool will be explained in detail with reference to the accompanying drawings.

Figure 1:
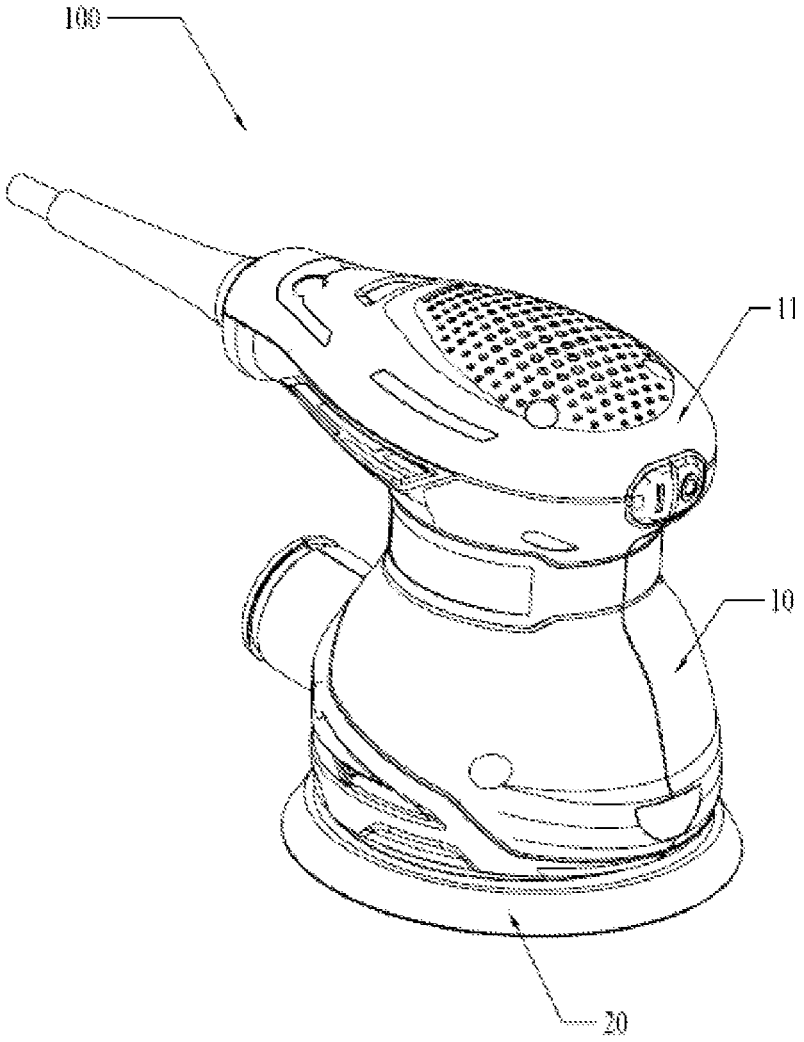
FIG. 1 is a structure schematic view of an exemplary embodiment of a power tool constructed according to the present disclosure.
Figure 2:
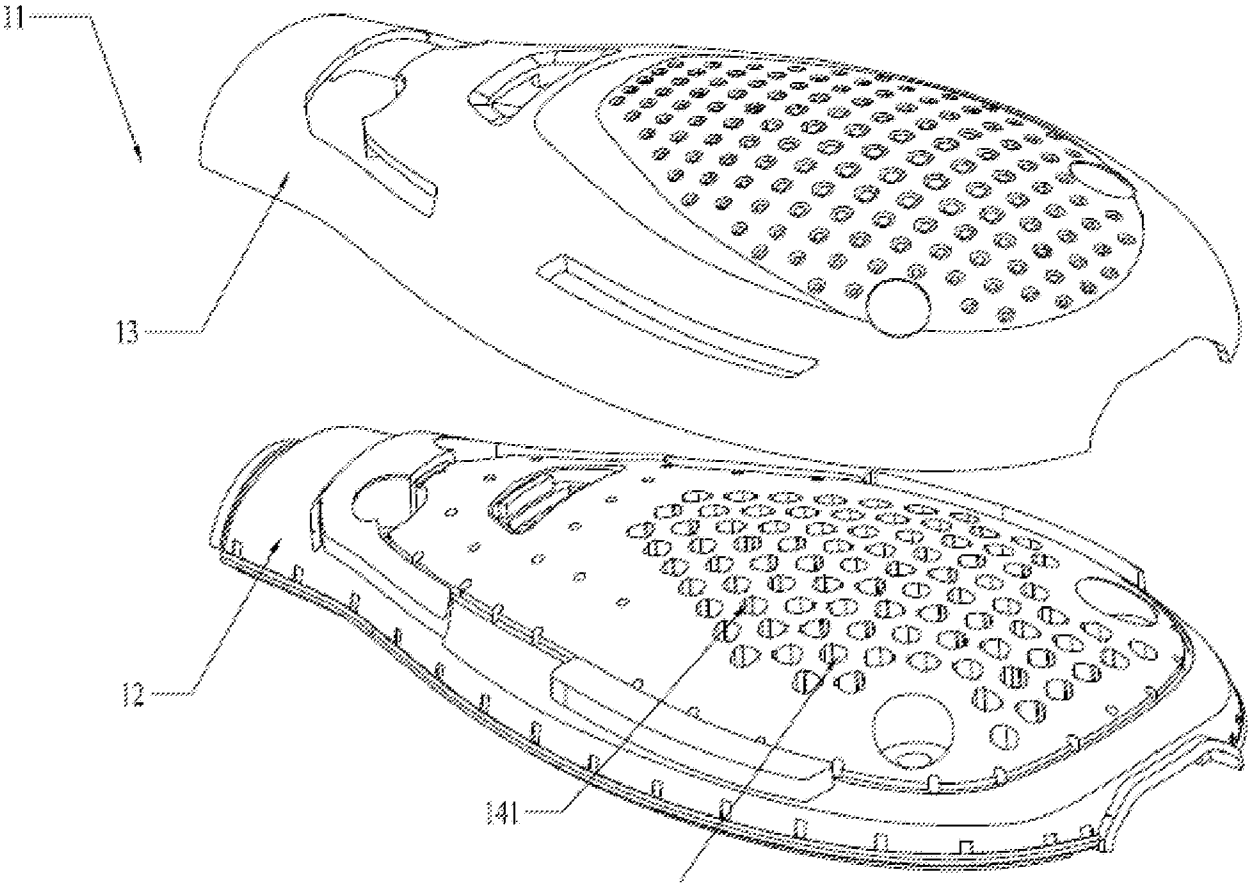
FIG. 2 is an exploded structure schematic view of a combined housing used in the power tool of FIG. 1.
Figure 3:
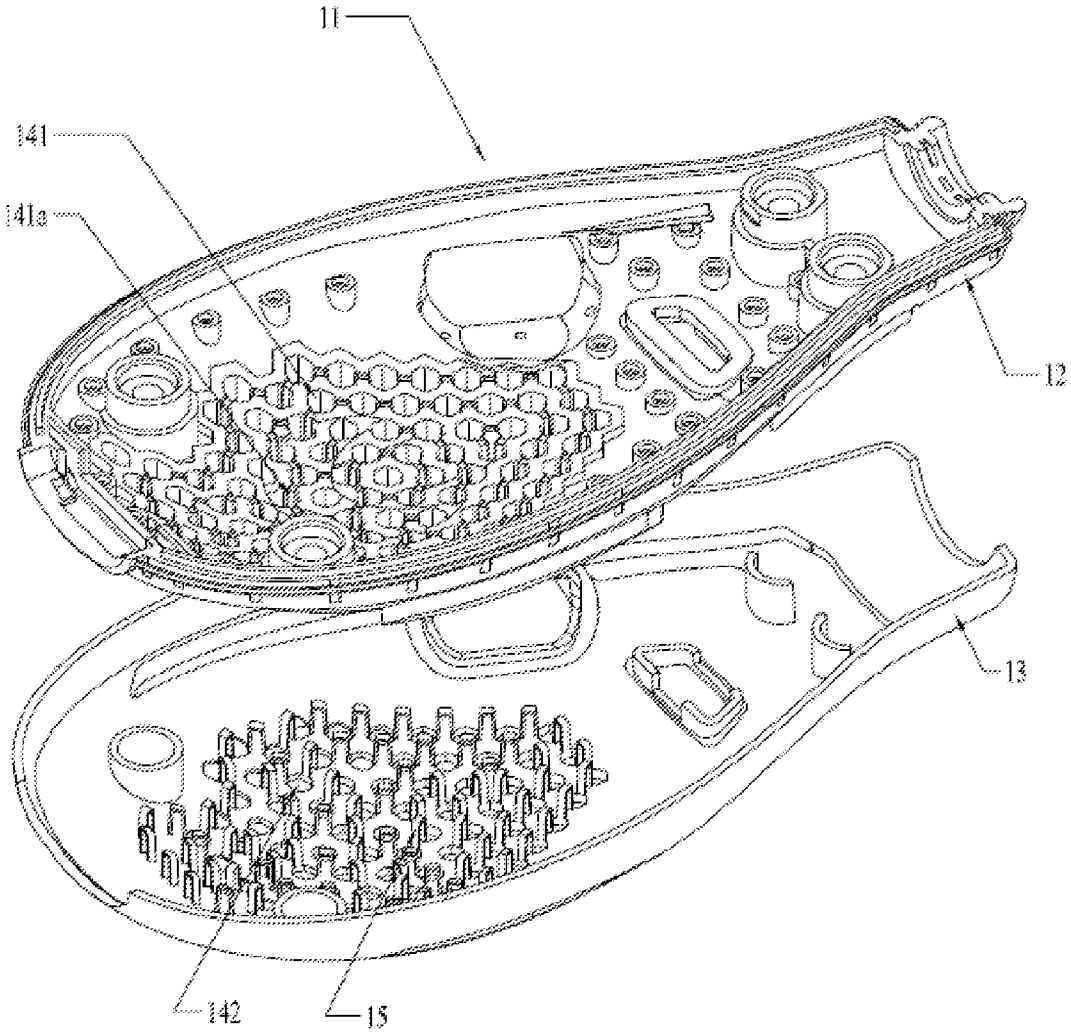
FIG. 3 is another exploded structure schematic view of the combined housing of FIG. 2 as viewed from another angle.
Figure 4:
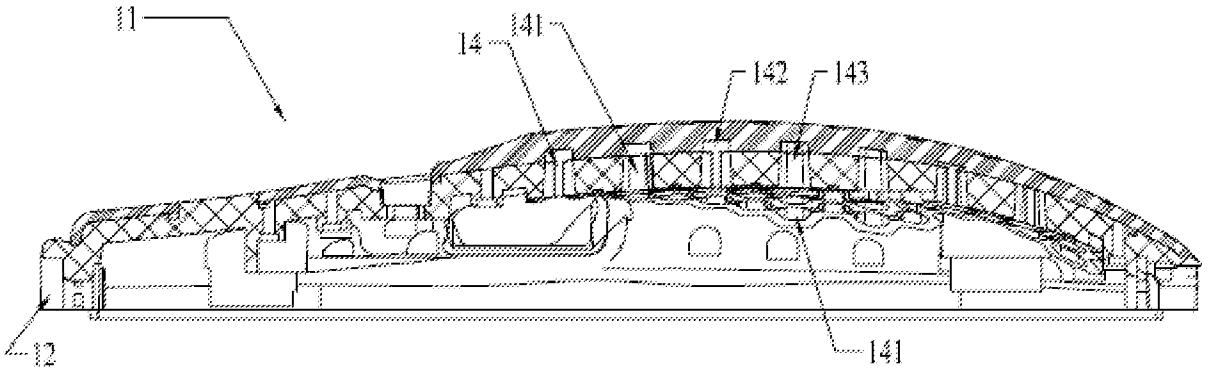
FIG. 4 is a sectional structure schematic view of the outer housing of FIG. 1.

Referring to FIGS. 1-4, an exemplary power tool according to the present disclosure may be a sander 100. The sander 100 comprises an outer housing 10, an inner assembly and a sanding base plate 20 driven to move by the inner assembly. Certainly, the power tool of the present disclosure may also be any one of angle grinder, circular saw, electric drill, electric screwdriver, grass trimmer, lawn mower, blower, pruner or chain saw. The above power tools are common tools in the industry, thus it is unnecessary to go into details here.

Specifically, the outer housing 10 comprises a combined housing 11. The combined housing 11 comprises an inner housing body 12 and an outer layer body 13. The outer layer body 13 is attached to the inner housing body 12. Generally, the inner housing body 12 may be formed by a material with a relatively high strength and hardness and serve as a portion mainly bearing loads and connecting other portions of the housing. The outer layer body 13 covers the inner housing body 12 to a certain degree, and mainly serves as a portion contacted by the hand of the user. The outer layer body 13 may be formed by a material that is more flexible than the material of the inner housing body 12. In respect of the manufacturing process, the inner housing body 12 may be molded firstly and then the outer layer body 13 is formed on the inner housing body 12 by injection molding.

To achieve a vibration-suppressing effect, the combined housing 11 comprises at least one vibration-suppressing area. The vibration-suppressing area is provided with a plurality of vibration-suppressing structure units 14. Each vibration-suppressing structure unit 14 comprises a unit channel 141 formed from the inner housing body 12 and passing though the inner housing body 12 and a unit groove 142 formed from the outer layer body 13 and closing one end of the unit channel. In other words, the inner housing body 12 is provided with a plurality of unit channels 141 with one end closed by the unit groove 142 formed by the outer layer body 13 so as to form a cavity with an opening end, i.e., a vibration-suppressing cavity 143 of the present disclosure.

It should be noted that when the combined housing 11 of the present disclosure serves as the outer housing, the majority of the outer layer body 13 is located outside, or the opening side of the vibration-suppressing cavity 143 is the inner side of the outer housing.

As a preferred embodiment, the vibration-suppressing structure units 14 are uniformly distributed in the vibration-suppressing area in order to make the structure of the inner housing body 12 uniform and avoid the problem of stress concentration.

As a preferred embodiment, the vibration-suppressing cavity 143 formed by the unit groove and the unit channel 141 in the vibration-suppressing structure unit 14 is gradually narrowed in a direction from the inner housing body 12 to the outer layer body 13. The thickness of the outer layer body 13 at the unit groove 142 is larger than or equal to the depth of the unit groove 142, and the portion of the outer layer body 13 having a maximum thickness is located in the vibration-suppressing area. As such, the size of the main portion of the outer layer body 13 occupied by the unit groove 142 is reduced, the effect of integrality of the grooving on the portion of the outer layer body 13 to be contacted by the hand of the user is reduced, and the effect of the grooving is therefore not obvious at the position adjacent to the portion of the outer layer body 13 to be contacted by the hand of the user.

As another effective vibration-suppressing design, the combined housing 11 further comprises a plurality of connecting portions 15. Each connecting portion 15 is formed from the outer layer body 13 and passes through the inner housing body 12 to connect with at least two different vibration-suppressing structure units 14.

It should be noted that the connecting portion 15 is formed by the outer layer body 13 and passes through the inner housing body 12 via the unit channel 141. The connecting portion 15 at least has two ends in two different vibration-suppressing structure units 14, and is used to bind the outer layer body 13 to the inner housing body 12. The connecting portion 15 disperses the vibrations, and this dispersion comprises the dispersion between the vibration-suppressing structure units 14 and the dispersion from the inner housing body 12 to the outer layer body 13. When the vibrations in one or some vibration-suppressing structure units 14 are relatively strong, since the connecting portion 15 connects different vibration-suppressing structure units 14 and contacts the inner housing body 12, the two different vibration-suppressing structure units 14 connected by the connecting portion 15 can transmit and disperse the vibrations, and the transmission and dispersion through the connecting portion 15 formed by the outer layer body 13 can significantly reduce the strength of the vibrations. When the inner housing body 12 vibrates, the inner housing body 12 transmits the vibrations to the outer layer body 13 through the ends of the plurality of the connecting portions 15. This vibration transmission is different from the transmission between the inner housing body 12 and the outer layer body 13 at the tightly-contacted interface, and the vibrations are directly and discretely transmitted to the end of the connecting portion 15 and therefore to the outer layer body 13 from the portion at which the connecting portion 15 contacts the inner housing body 12. Accordingly, this transmission also can suppress the vibration.

Additionally, the connecting portion 15 is tightly contacted with the inner housing body 12. In fact, due to the injection molding, each portion of the outer layer body 13 is tightly contacted with the inner housing body 12.

As a preferred solution, the ends of the connecting portion 15 are formed at the edge of the unit groove 142, and the cavity wall of the vibration-suppressing cavity 143 formed by the unit channel 141 and the unit groove 142 is smooth, thereby ensuring the integrity of the unit groove 142 and facilitating the molding. In order to prevent the connecting portion 15 from damaging the smooth structure of the vibration-suppressing cavity 143, the channel wall of the unit channel 141 is provided with a slot 141*a* for embedding the connecting portion 15. This design further stops the connecting portion 15 and facilitates the shaping during the molding.

As a further preferred solution, the vibration-suppressing cavity 143 formed by the unit channel 141 and the unit groove 142 has a symmetrical structure with respect to a central axis, and the sectional plane of the cavity wall taken along a plane perpendicular to the plane of the central axis has a closed shape and comprises a plurality of straight edges. In other words, if the space in the vibration-suppressing cavity 143 has a three-dimensional structure, the three-dimensional structure has a central axis and has a symmetrical structure about the center of the axis relative to the central axis, and comprises a plurality of planes. As a further preferred solution, in the same vibration-suppressing area, the central axis of the vibration-suppressing cavity 143 in each vibration-suppressing structure unit 14 is equally distanced from the central axis of the vibration-suppressing cavity 143 in the adjacent vibration-suppressing structure unit 14. In other words, in respect of one vibration-suppressing area, all vibration-suppressing structure units 14 are uniformly distributed. This design can ensure the manufacturing process and corresponding structure strength.

As a further preferred solution, the sectional plane of the vibration-suppressing cavity 143 formed by the unit channel 141 and the unit groove 142 taken along the plane perpendicular to the plane of the central axis comprises six straight edges having the same length. As shown in FIGS. 1-4, with this design, the vibration-suppressing structure units 14 in the vibration-suppressing area form a structure like "honeycomb." As such, firstly, in the same total area of the vibration-suppressing area, a maximum area of the unit channel 141 may be obtained, thereby achieving an optimum vibration-blocking effect; secondly, this design can simplify the structure of the channel wall of the unit channel 141 and facilitate the arrangement of the connecting portions 15.

The above illustrates and describes basic principles, main features and advantages of the present disclosure. Those skilled in the art should appreciate that the above embodiments are not intended to limit the invention claimed in any form. Rather, technical solutions obtained in a way of equivalent substitution or equivalent variations are intended to fall within the scope of the claims which follow.

What is claimed is:

1. A combined housing having at least one vibration-suppressing area, comprising:

an inner housing body; and an outer layer body attached to the outside of the inner housing body;

wherein the vibration-suppressing area is provided with a plurality of vibration-suppressing structure units and each vibration-suppressing structure unit comprises:

a unit channel formed by the inner housing body, the unit channel extending through the inner housing body; and a unit groove formed by the outer layer body and arranged on one end of the unit channel;

wherein the unit groove and the unit channel of each vibration-suppressing structure unit form a vibration-suppressing cavity, wherein the inner housing body further comprises a first surface attached to the outer layer body and a second surface opposite to the first surface, the unit channel is a through hole passing through the inner housing body along a central axis, and the through hole has a first end connected with the first surface and a second end connected with the second surface along the central axis, wherein the unit groove extends along the central axis, and wherein the outer layer body is provided with a plurality of connecting portions at least extending from one vibration-suppressing cavity to another vibration-suppressing cavity, and each connecting portion comprises a first part, a second part, and third part, wherein the first part is accommodated inside one through hole, the second part is accommodated inside another through hole, and the third part connects the first part and the second part.

2. The combined housing according to claim 1, wherein the vibration-suppressing structure units are uniformly distributed in the vibration-suppressing area.

3. The combined housing according to claim 1, wherein the depth of the unit groove is smaller than the length of the unit channel in each vibration-suppressing structure unit.

4. The combined housing according to claim 1, wherein the vibration-suppressing cavity is gradually narrowed from the interior to the exterior thereof.

5. The combined housing according to claim 1, wherein a portion of the outer layer body having a maximum thickness is located in the vibration-suppressing area.

6. The combined housing according to claim 1, wherein the connecting portions are tightly contacted with the inner housing body.

7. The combined housing according to claim 1, wherein the ends of the connecting portions are respectively formed at the edges of the unit grooves.

8. The combined housing according to claim 1, wherein a channel wall of the unit channel is provided with a channel slot for embedding the connecting portion.

9. The combined housing according to claim 8, wherein the vibration-suppressing cavity has a symmetrical structure relative to a central axis thereof.

10. The combined housing according to claim 9, wherein a sectional plane of the vibration-suppressing cavity has a closed shape and comprises a plurality of straight edges.

11. The combined housing according to claim 10, wherein the number of the straight edges of the sectional plane of the vibration-suppressing cavity is even.

12. The combined housing according to claim 11, wherein the sectional plane of the vibration-suppressing cavity is a hexagon.

13. The combined housing according to claim 12, wherein the distances between the central axes of the vibration-suppressing cavities of the vibration-suppressing structure units are the same.

14. The combined housing according to claim 1, wherein a material of the outer layer body is more flexible than the material of the inner housing body.

15. A power tool, comprising:

an outer housing; and an inner working assembly for driving a tool accommodated in the outer housing;

wherein the outer housing comprises:

a combined housing having at least one vibration-suppressing area, the combined housing comprising an inner housing body and an outer layer body attached to the outside of the inner housing body, the vibration-suppressing area is provided with a plurality of vibration-suppressing structure units, each vibration-suppressing structure unit comprises a unit channel formed by the inner housing body, the unit channel passing through the entire width of the inner housing body and a unit groove formed by the outer layer body and arranged on one end of the unit channel, the unit groove and the unit channel of each vibration-suppressing structure unit form a vibration-suppressing cavity, and the outer layer body serves as the outside of the outer housing, wherein the inner housing body comprises a first surface attached to the outer layer body and a second surface opposite to the first surface, the unit channel is a through hole passing through the inner housing body along a central axis, and the through hole has a first end connected with the first surface and a second end connected with the second surface along the central axis, wherein the unit groove extends along the central axis, and wherein the outer layer body is provided with a plurality of connecting portions at least extending from one vibration-suppressing cavity to another vibration-suppressing cavity, and each connecting portion comprises a first part, a second part, and third part, wherein the first part is accommodated inside one through hole, the second part is accommodated inside another through hole, and the third part connects the first part and the second part.

16. The power tool according to claim 15, wherein the outer housing comprises a contacting portion for forming a handle to be handled by a user, and the vibration-suppressing area of the combined housing is at least arranged on the contacting portion.

17. The power tool according to claim 16, wherein the power tool may be any one of sander, angle grinder, circular saw, electric drill, electric screwdriver, grass trimmer, lawn mower, blower, pruner or chain saw.

18. The power tool according to claim 15, wherein the power tool may be any one of sander, angle grinder, circular saw, electric drill, electric screwdriver, grass trimmer, lawn mower, blower, pruner or chain saw.

* * * * *